US011830451B1

(12) United States Patent
Zhao et al.

(10) Patent No.: US 11,830,451 B1
(45) Date of Patent: Nov. 28, 2023

(54) FULL GRAYSCALE SUBJECTIVE CONSISTENCY OPTICAL DATA OBTAINING METHOD AND SPLICING DISPLAY PANEL

(71) Applicants: Huizhou China Star Optoelectronics Display Co., Ltd., Guangdong (CN); TCL China Star Optoelectronics Technology Co., Ltd., Guangdong (CN)

(72) Inventors: Jun Zhao, Guangdong (CN); Bin Zhao, Guangdong (CN); Juncheng Xiao, Guangdong (CN); Hongyuan Xu, Guangdong (CN); Guangmiao Wan, Guangdong (CN); Zhongbin Wang, Guangdong (CN); Meinan Li, Guangdong (CN); Maoxia Zhu, Guangdong (CN); Yu Liu, Guangdong (CN)

(73) Assignee: Huizhou China Star Optoelectronics Display Co., Ltd., Guangdong (CN)

( * ) Notice: Subject to any disclaimer, the term of this patent is extended or adjusted under 35 U.S.C. 154(b) by 0 days.

(21) Appl. No.: 18/077,069

(22) Filed: Dec. 7, 2022

(51) Int. Cl.
*G09G 3/36* (2006.01)
*G09G 3/20* (2006.01)
*G09G 3/32* (2016.01)

(52) U.S. Cl.
CPC ..... *G09G 3/3607* (2013.01); *G09G 3/2007* (2013.01); *G09G 3/32* (2013.01); *G09G 3/364* (2013.01); *G09G 2320/0271* (2013.01); *G09G 2320/0693* (2013.01); *G09G 2360/04* (2013.01)

(58) Field of Classification Search
CPC ..... G09G 3/3607
USPC ..... 345/30
See application file for complete search history.

(56) References Cited

U.S. PATENT DOCUMENTS

2014/0198251 A1* 7/2014 Li ..... H04N 9/12 348/453
2019/0318669 A1* 10/2019 Wu ..... G09F 9/3026
2020/0111771 A1* 4/2020 Su ..... H01L 25/167
2022/0236608 A1* 7/2022 Yang ..... G02F 1/133638

* cited by examiner

*Primary Examiner* — Long D Pham
(74) *Attorney, Agent, or Firm* — Taft Stettinius & Hollister LLP

(57) ABSTRACT

The present invention provides a full grayscale subjective consistency optical data obtaining method and a splicing display panel, an initial splicing display panel includes splicing and disposing first display panel (liquid crystal display panel) and second display panel in different types. The method includes: obtaining a plurality of bonding point colors, sets of reference bonding point optical parameters and sets of bonding point optical parameters of the first display panel and the second display panel corresponding to the bonding point colors respectively, and determining non-bonding point optical parameters in the second display panel corresponding to non-bonding point colors between adjacent two of the bonding point colors. A display image of the second display panel under effect of each set of the bonding point optical parameters is subjectively consistent with a display image of the first display panel under effect of a set of the reference bonding point optical parameters.

10 Claims, 11 Drawing Sheets

FULL GRAYSCALE SUBJECTIVE CONSISTENCY OPTICAL DATA OBTAINING METHOD AND SPLICING DISPLAY PANEL

CROSS-REFERENCE TO RELATED APPLICATIONS

This application claims priority to Chinese Patent Application No. 202211478062.4 filed on Nov. 23, 2022, which is incorporated by reference herein in its entirety.

FIELD OF INVENTION

The present invention relates to a field of display technologies, especially to a full grayscale subjective consistency optical data obtaining method and a splicing display panel.

BACKGROUND OF INVENTION

A splicing display panel can comprise spliced micro light emitting diode (MLED) and mini LED direct view displays or spliced liquid crystal displays (LCDs).

A MLED direct view display can achieve ultra-large size splicing, is convenience for installation, but has a higher cost. An LCD has a lower splicing cost but has a poor splicing effect. Therefore, attaching MLEDs in splicing slits of the LCD to eliminate the splicing slits can balance the display effect and cost. However, due to a difference of distributions of spectral powers of the LCD and MLED, metamerism exists, which results in a difference between visual colors of the LCD and MLED and therefore causes a greater subjective color difference of a splicing display panel mixed with LCD and MLED.

Therefore, the conventional splicing display panel mixed with LCD and MLED has a phenomenon of a greater subjective color difference resulting from a greater spectral difference between the LCD and the MLED.

SUMMARY OF INVENTION

The embodiment of the present invention provides a full grayscale subjective consistency optical data obtaining method and a splicing display panel to solve to solve the conventional splicing display panel mixed with an LCD and a MLED has a technical issue of a greater subjective color difference resulting from a greater spectral difference between the LCD and the MLED.

The embodiment of the present invention provides a full grayscale subjective consistency optical data obtaining method, configured to obtain optical data applied to an initial splicing display panel, wherein the initial splicing display panel comprises a first display panel and a second display panel spliced together, the first display panel comprises a liquid crystal display panel, the second display panel is different from the first display panel in type, and the method comprises:

obtaining a plurality of bonding point colors, sets of reference bonding point optical parameters of the first display panel corresponding to the bonding point colors and sets of bonding point optical parameters of the second display panel corresponding to the bonding point colors, wherein a display image of the second display panel under effect of each set of the bonding point optical parameters is subjectively consistent with a display image of the first display panel under a corresponding set of the reference bonding point optical parameters;

determining non-bonding point optical parameters of the second display panel corresponding to non-bonding point colors between adjacent two of the bonding point colors according to the bonding point colors, the sets of the reference bonding point optical parameters, and the sets of the bonding point optical parameters; and determining the optical data according to a correspondence between the bonding point colors and the sets of the bonding point optical parameters and according to a correspondence between the non-bonding point colors and the sets of the non-bonding point optical parameters.

In an embodiment, the step of determining non-bonding point optical parameters of the second display panel corresponding to non-bonding point colors between adjacent two of the bonding point colors according to the bonding point colors, the sets of the reference bonding point optical parameters, and the sets of the bonding point optical parameters, comprises:

determining a functional relationship between the bonding point optical parameters and the reference bonding point optical parameters according to the sets of the bonding point optical parameters and the sets of the reference bonding point optical parameters; and determining a corresponding set of the non-bonding point optical parameters according to the functional relationship and sets of reference non-bonding point optical parameters of the first display panel corresponding to the non-bonding point colors.

In an embodiment, the step of determining the corresponding set of the non-bonding point optical parameters according to the functional relationship and the sets of the reference non-bonding point optical parameters, comprises:

determining some of the non-bonding point optical parameters corresponding to some of the non-bonding point colors in the second display panel corresponding to some of the reference non-bonding point optical parameters according to the functional relationship and some of the reference non-bonding point optical parameters; and determining another some of the non-bonding point optical parameters in the second display panel corresponding to another some of the non-bonding point colors according to a correspondence between the bonding point colors and the corresponding set of the reference bonding point optical parameters and a correspondence between some of the non-bonding point colors and corresponding some of the non-bonding point optical parameters.

In an embodiment, each set of the reference bonding point optical parameters comprises a first sub-reference bonding point optical parameter, a second sub-reference bonding point optical parameter, and a third sub-reference bonding point optical parameter, each set of the bonding point optical parameters comprises a first sub-bonding point optical parameter, a second sub-bonding point optical parameter, and a third sub-bonding point optical parameter;

wherein the step of determining a functional relationship between the bonding point optical parameters and the reference bonding point optical parameters according to the sets of the bonding point optical parameters and the sets of the reference bonding point optical parame, comprises:

determining a first functional relationship between the first sub-bonding point optical parameter and the first sub-reference bonding point optical parameter according to the first sub-bonding point optical parameter and the first sub-reference bonding point optical parameter;

determining a second functional relationship between the second sub-bonding point optical parameter and the second sub-reference bonding point optical parameter according to the second sub-bonding point optical parameter and the second sub-reference bonding point optical parameter; and determining a third functional relationship between the third sub-bonding point optical parameter and the third sub-reference bonding point optical parameter according to the third sub-bonding point optical parameter and the third sub-reference bonding point optical parameter.

In an embodiment, each set of the non-bonding point optical parameters comprises a first sub non-bonding point optical parameter, a second sub non-bonding point optical parameter, and a third sub non-bonding point optical parameter, each set of the reference non-bonding point optical parameters comprises a first sub-reference non-bonding point optical parameter, a second sub-reference non-bonding point optical parameter, and a third sub-reference non-bonding point optical parameter;

wherein the step of determining the corresponding set of the non-bonding point optical parameters according to the functional relationship and the sets of the reference non-bonding point optical parameters, comprises:

determining the first sub non-bonding point optical parameter of a corresponding set of the non-bonding point optical parameters according to the first functional relationship and each of the first sub-reference non-bonding point optical parameter;

determining the second sub non-bonding point optical parameter of a corresponding set of the non-bonding point optical parameters according to the second functional relationship and each of the second sub-reference non-bonding point optical parameter; and determining the third sub non-bonding point optical parameter of a corresponding set of the non-bonding point optical parameters according to the third functional relationship and each of the third sub-reference non-bonding point optical parameter.

In an embodiment, before the step of obtaining a plurality of bonding point colors, sets of reference bonding point optical parameters of the first display panel corresponding to the bonding point colors and sets of bonding point optical parameters of the second display panel corresponding to the bonding point colors, the method comprises:

converting sets of reference bonding point optical parameters to be converted into the sets of the reference bonding point optical parameters, and converting sets of bonding point optical parameters to be converted into the sets of the bonding point optical parameters according to a first conversion rule.

In an embodiment, the step of determining non-bonding point optical parameters of the second display panel corresponding to non-bonding point colors between adjacent two of the bonding point colors according to the bonding point colors, the sets of the reference bonding point optical parameters, and the sets of the bonding point optical parameters, comprises:

the according to the bonding point colors, the sets of the reference bonding point optical parameters and the sets of the bonding point optical parameters, determining non-bonding point optical parameters to be converted in the second display panel corresponding to the non-bonding point colors; and converting the sets of the non-bonding point optical parameters to be converted into the sets of the non-bonding point optical parameters according to a second conversion rule.

In an embodiment, the step of determining non-bonding point optical parameters of the second display panel corresponding to non-bonding point colors between adjacent two of the bonding point colors according to the bonding point colors, the sets of the reference bonding point optical parameters, and the sets of the bonding point optical parameters, comprises:

determining the non-bonding point optical parameters of the second display panel corresponding to the non-bonding point colors at least according to a first interpolation rule determined by the bonding point colors and the sets of the reference bonding point optical parameters.

In an embodiment, the step of determining the non-bonding point optical parameters of the second display panel corresponding to the non-bonding point colors at least according to a first interpolation rule determined by the bonding point colors and the sets of the reference bonding point optical parameters, comprises:

obtaining sets of reference non-bonding point optical parameters of the first display panel corresponding to the non-bonding point colors, and determining a second interpolation rule according to the first interpolation rule, the non-bonding point colors and the sets of the reference non-bonding point optical parameters; and at least according to the second interpolation rule, determining the non-bonding point optical parameters of the second display panel corresponding to the non-bonding point colors.

The embodiment of the present invention provides a splicing display panel, comprising:

the initial splicing display panel as described above;

a signal transmitting card electrically connected to the first display panel and the second display panel in the initial splicing display panel;

wherein the optical data is stored in the signal transmitting card, and the optical data is at least configured to control the second display panel to display images.

The present invention provides a full grayscale subjective consistency optical data obtaining method and a splicing display panel, configured to obtain optical data applied to an initial splicing display panel, wherein the initial splicing display panel comprises a first display panel and a second display panel spliced together, the first display panel comprises a liquid crystal display panel, the second display panel is different from the first display panel in type, and the method comprises: obtaining a plurality of bonding point colors and sets of reference bonding point optical parameters of the first display panel corresponding to the bonding point colors, and determining sets of bonding point optical parameters of the second display panel corresponding to the bonding point colors according to the bonding point colors and the sets of the reference bonding point optical parameters of the first display panel; determining non-bonding point optical parameters of the second display panel corresponding to non-bonding point colors between adjacent two of the bonding point colors according to the bonding point colors, the sets of the reference bonding point optical parameters, and the sets of the bonding point optical parameters; and determining the optical data according to a correspondence between the bonding point colors and the sets of the bonding point optical parameters and according to a correspondence between the non-bonding point colors and the sets of the non-bonding point optical parameters. Because at least one of the three-dimensional color parameter chart and the color parameter table of the second display panel that the second display panel relies on relates to the sets of reference bonding point optical parameters of the first display panel corresponding to the bonding point colors and is obtained by a human factor experiment, a subjective color difference between display images of the first display panel (liquid crystal display panel) and the second display panel (MLED) can be effectively decreased, which improves quality of display images of the splicing display panel.

DESCRIPTION OF DRAWINGS

The present invention is further described by attached drawings as follows. It should be explained that the following accompanying drawings of the descriptions are only some embodiments of the present application, for a person of ordinary skill in the art, can also be used for obtaining other accompanying drawings under a prerequisite without creative efforts.

DETAILED DESCRIPTION OF PREFERRED EMBODIMENTS

The technical solution in the embodiment of the present application will be clearly and completely described below with reference to the accompanying drawings in the embodiments of the present application. Apparently, the described embodiments are merely some embodiments of the present application instead of all embodiments. According to the embodiments in the present application, all other embodiments obtained by those skilled in the art without making any creative effort shall fall within the protection scope of the present application.

The terms "first", "second", etc. in the description and claims of the present application and the above-mentioned drawings are used to distinguish different objects, not to describe a specific order. In addition, the terms "include" and "have" and any deformation of them is intended to cover non-exclusive inclusion. For example, it comprises processes, method, system, product, or apparatus of a series of steps or modules, is not limited by listed steps or modules, and can optionally further comprise steps or modules not listed, or optionally can further comprise inherent other steps or modules for these processes, methods, products, or apparatuses.

"Embodiment" mentioned in the specification means that specific features, structures, or characteristics described in combination with the embodiments can be included in at least one embodiment of the present invention. Terminologies presenting at each location of the specification do not necessarily refer to the same embodiment, and are either not an individual or backup embodiment mutually exclusive to other embodiment. A person of ordinary skill in the art can explicitly or implicitly understand that the embodiment described in the specification can combine other embodiment.

The embodiment of the present invention provides a full grayscale subjective consistency optical data obtaining method and a splicing display panel that will be described respectively in detail as follows.

The embodiment of the present invention provides a full grayscale subjective consistency optical data obtaining method. Each step of the full grayscale subjective consistency optical data obtaining method of the embodiment of the present invention is described in detail as follows.

Figure 1:
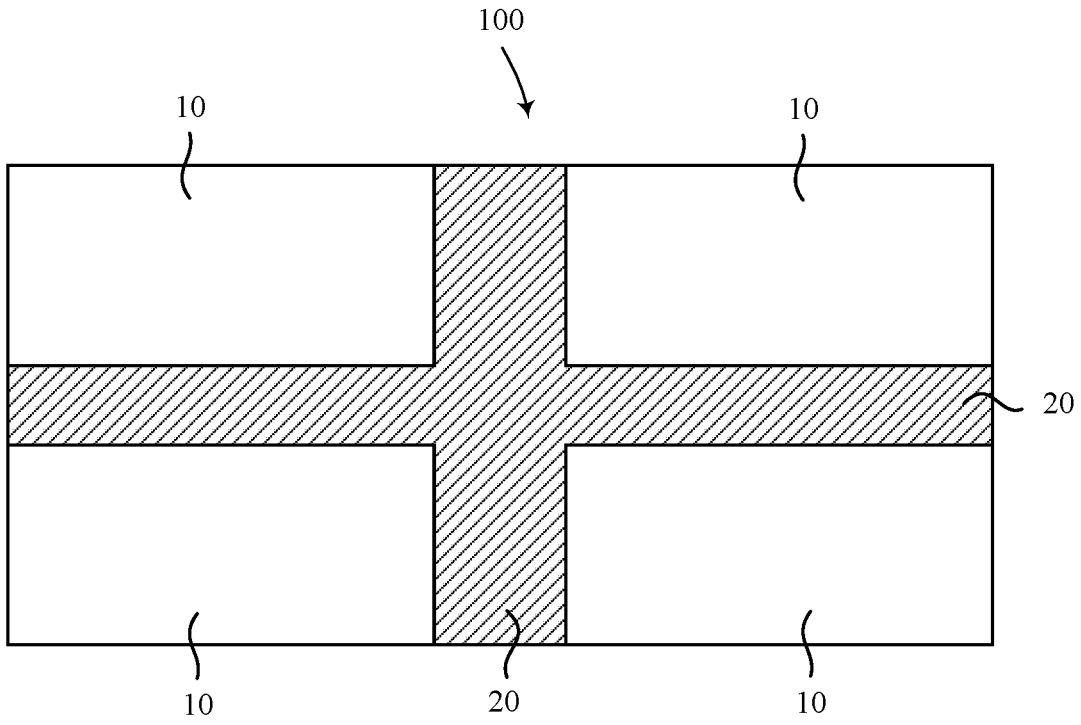
FIG. 1 is a schematic top view of an initial splicing display panel or a splicing display panel provided by the embodiment of the present invention.
Figure 2:
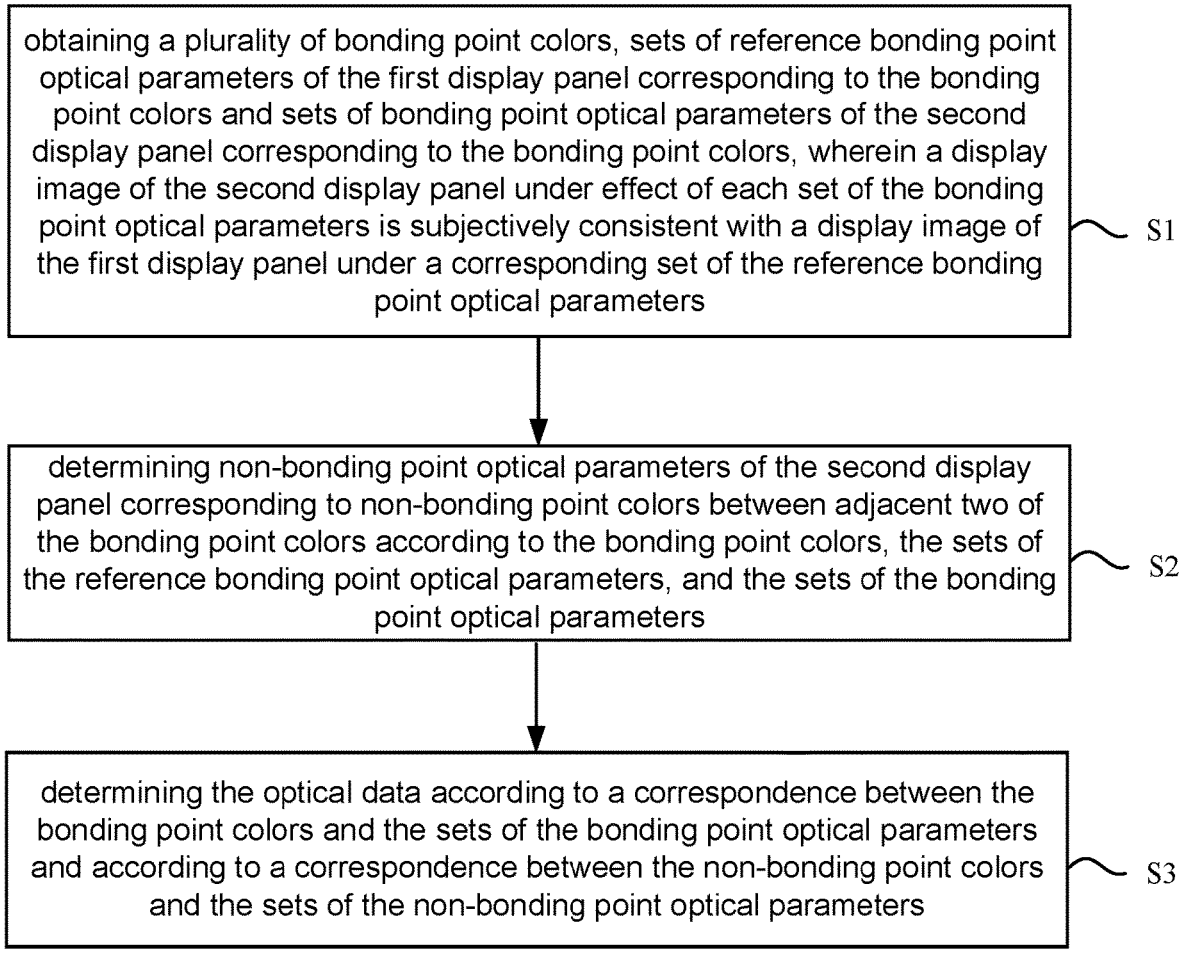
FIG. 2 is a flowchart of a full grayscale subjective consistency optical data obtaining method provided by the embodiment of the present invention.

In an embodiment, the full grayscale subjective consistency optical data obtaining method is applied to an initial splicing display panel. With reference to FIG. 1, the initial splicing display panel 100 comprises a first display panel 10 and a second display panel 20 spliced together. The first display panel 10 and the second display panel 20 are different in type. With reference to FIG. 2, the full grayscale subjective consistency optical data obtaining method comprises but is not limited to the following steps and a combination of the steps.

A step S1 comprises obtaining a plurality of bonding point colors, sets of reference bonding point optical parameters of the first display panel corresponding to the bonding point colors and sets of bonding point optical parameters of the second display panel corresponding to the bonding point colors, wherein a display image of the second display panel under effect of each set of the bonding point optical parameters is subjectively consistent with a display image of the first display panel under a corresponding set of the reference bonding point optical parameters.

In particular, with reference to FIG. 1, the initial splicing display panel 100 comprises the first display panel 10, a slit is formed between adjacent two of the first display panel 10, and the slit is filled with the corresponding second display panel 20. The first display panel 10 comprises a liquid crystal display panel. The second display panel 20 comprises at least one of a micro LED display panel and a mini LED display panel. It can be understood that a splicing cost of the liquid crystal display panel is lower. However, a splicing slit is greater because of reasons such as a frame. Sizes of light emitting devices of the micro LED display panel and the mini LED display panel are extremely small. Therefore, at least one of the Micro LED display panel and the Mini LED display panel (the second display panel 20) is disposed between adjacent two of the liquid crystal display panel (the first display panel 10), which can effectively reduce the slit inside the initial splicing display panel 100. It should be noticed that because distributions of spectral powers of the LCD and the MLED are different, metamerism exists, which results in different visual colors thereof. Therefore, a subjective color difference would be greater in the initial splicing display panel 100 without mitigation of color difference between the LCD and the MLED.

Figure 3:
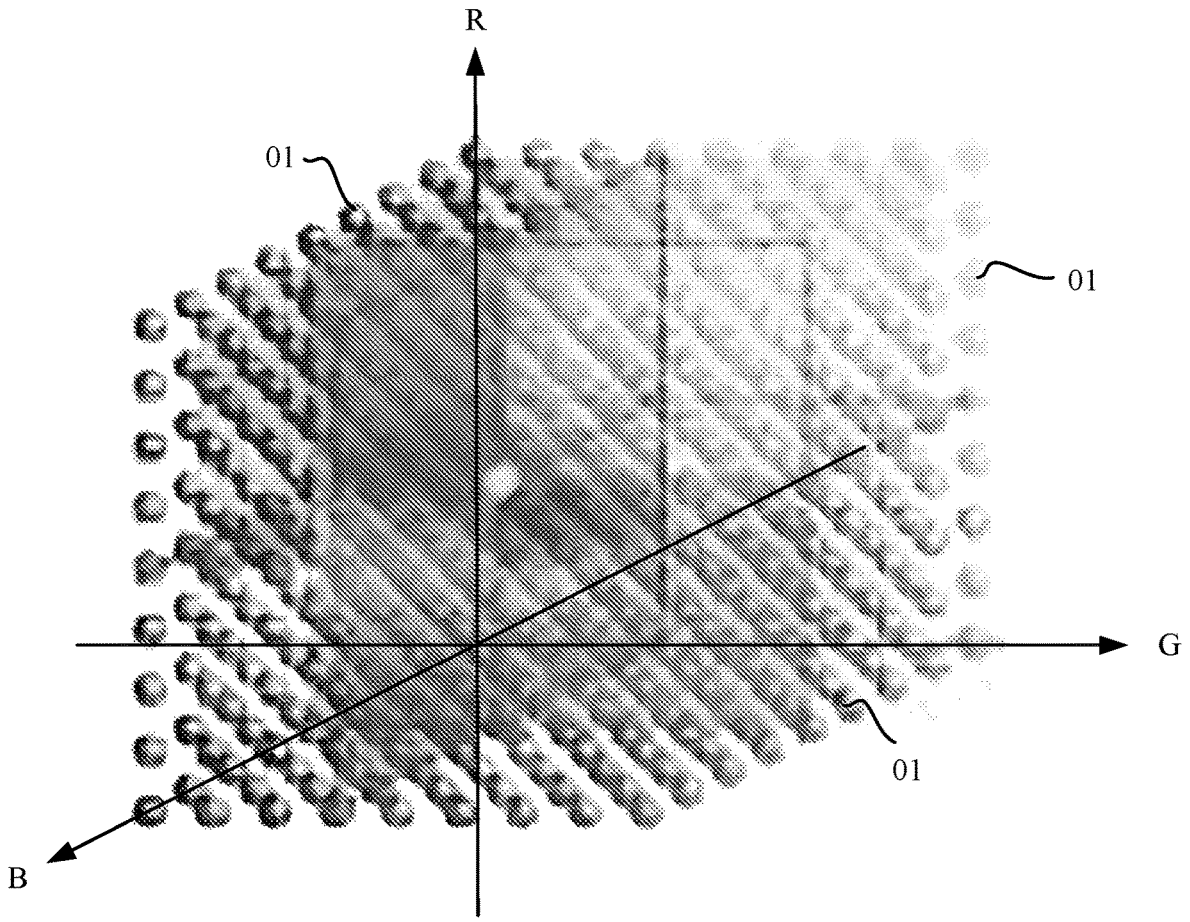
FIG. 3 is a three-dimensional color parameter chart of a first display panel provided by the embodiment of the present invention.
Figure 4:
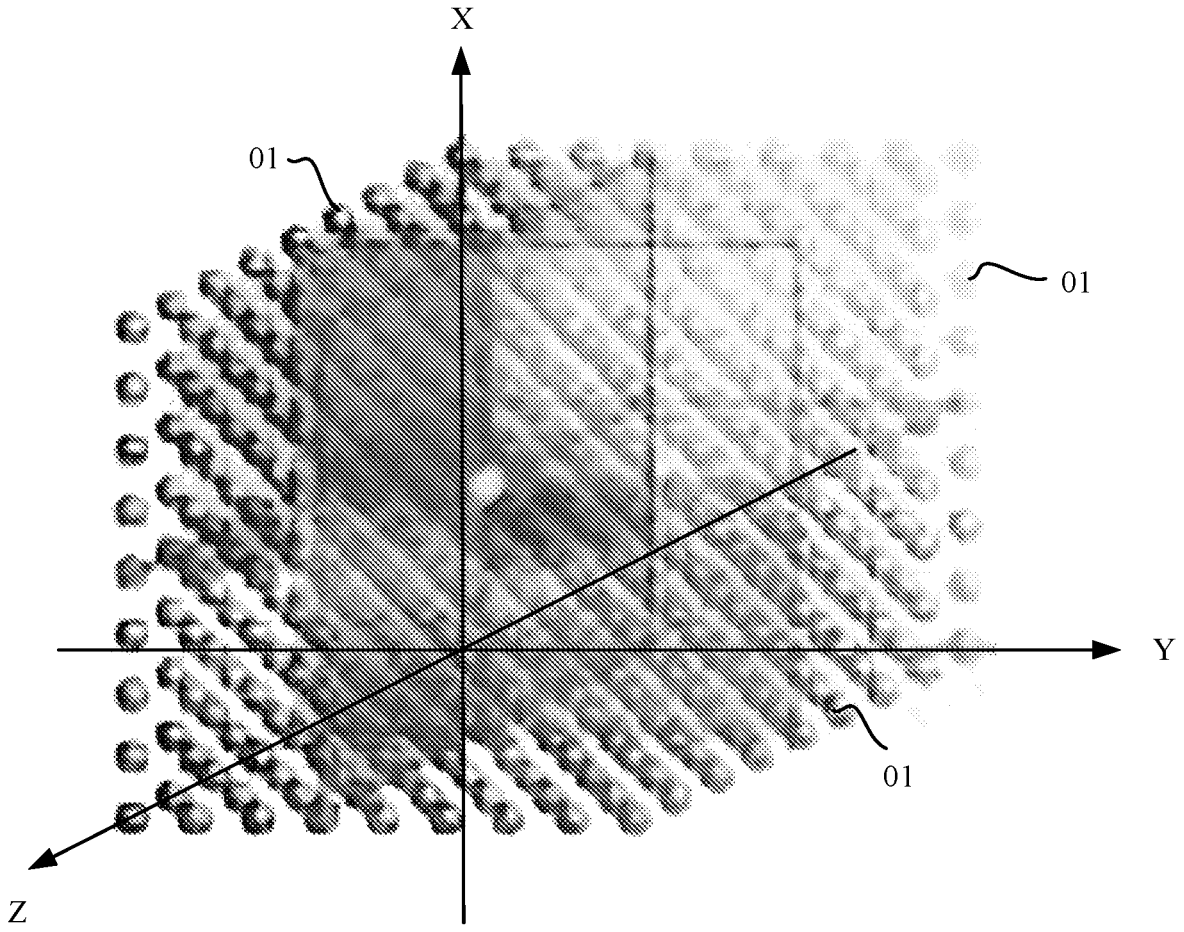
FIG. 4 is a three-dimensional color parameter chart of a second display panel provided by the embodiment of the present invention.

In particular, the first display panel 10 and the second display panel 20 can have corresponding three-dimensional color parameter charts respectively. With reference to FIGS. 3 and 4, the three-dimensional color parameter chart can comprise a first parameter axis, a second parameter axis, and a third parameter axis extending along different directions and intersecting at an origin. Each two of the first parameter axis, the second parameter axis, and the third parameter axis are perpendicular to each other to present a three-dimensional space. Values corresponding to three parameter axes can indicate different optical parameters respectively. Namely, a color of each point 01 in the three-dimensional space can be determined by a value of three optical parameters corresponding to a location of the point. For example, with reference to FIG. 3, optical parameters corresponding to the first parameter axis, the second parameter axis, and the third parameter axis can be a red grayscale value R, a green grayscale value G, and a blue grayscale value B respectively. Also, as shown in FIG. 4, the optical parameters corresponding to the first parameter axis, the second parameter axis, and the third parameter axis can also be a red stimulus value X, a green stimulus value Y, and a blue stimulus value Z respectively.

In combination with the above description and Table 1, the present embodiment indicates a three-dimensional color parameter chart of the first display panel 10 (for example, a liquid crystal display panel) by a red grayscale value R, a blue grayscale value B, and a green grayscale value G three parameter axes as shown in FIG. 3 (namely, each set of "reference bonding point optical parameters" in the step S1 can comprise a red grayscale value R, a blue grayscale value B, and a green grayscale value G), indicates the second display panel 20 (for example, a MLED) by a red stimulus value X, a green stimulus value Y, and a blue stimulus value Z three parameter axes as shown in FIG. 4 (namely, each set of "bonding point optical parameters" in the step S1 can comprise a red stimulus value X, a green stimulus value Y, and a blue stimulus value Z), as an example for explanation. Each point in the three-dimensional color parameter chart can be understood as a color corresponding to three values corresponding to the three parameter axes (can be any one of brightness and chroma, can be indicated by a pure color image).

Of course, the three-dimensional color parameter charts for indicating the first display panel 10 and the second display panel 20 can also be switched actually, or both can be the same. In particular, as shown in Table 1, each image (for example, one of F1 to Fn) serves as a pure color image (presenting a bonding point color), as an example for explanation. Namely, in the first display panel 10 and the second display panel 20, R values (or X values) of sub-pixels of all pixel units are the same, G values (or Y values) in all of the pixel units are the same, and B values (or Z values) of all of the pixel units are the same such that the first display panel 10 and the second display panel 20 present the same pure color image by the same bonding point colors.

TABLE 1

| | First display panel (liquid crystal display panel) | | | Second display panel (MLED) | | |
|---|---|---|---|---|---|---|
| Image | R | G | B | X | Y | Z |
| F1 | r1 | g1 | b1 | x1 | y1 | z1 |
| F2 | r2 | g2 | b2 | x2 | y2 | z2 |
| F3 | r3 | g3 | b3 | x3 | y3 | z3 |
| . . . | . . . | . . . | . . . | . . . | . . . | . . . |
| Fn | rn | gn | bn | xn | yn | zn |

In particular, in combination with the above description, in the step S1, when the first display panel 10 (liquid crystal display panel) displays each image (F1, F2, or Fn), by a human factor experiment, instrument process without limit, by adjusting X values, Y values, and Z values of all of the pixel unit pixels of the second display panel 20 (MLED), corresponding X values, Y values, and Z values of all of the pixel units of the second display panel 20, when a display image of the second display panel 20 is subjectively consistent with a display image of the first display panel 10 (namely, the same bonding point colors are presented, the bonding point colors comprise but are not limited to subjectively consistent brightness, chroma), is determined to serve as a set of bonding point optical parameters for displaying a display image of the bonding point colors. Similarly, X values, Y values, and Z values of all of the pixel units of the second display panel 20 corresponding to each of n ones of images (F1 to Fn) can be determined such that n sets of X values, Y values, and Z values ("x1, y1, z1" to "xn, yn, zn") are obtained to serve as n sets of bonding point optical parameters.

The human factor experiment can be implemented specifically by the following method: adjusting three optical parameters of the second display panel 20, wherein when a display image of the second display panel 20 observed by human's eyes is subjectively consistent with a display image of the first display panel 10, value of the three optical parameters of the second display panel 20 serve as a set of bonding point optical parameters of the second display panel 20 corresponding to the bonding point colors.

As described above, "a plurality of bonding point colors" can be understood as n ones of brightness or chroma corresponding to n ones of images mentioned above. "Sets of bonding point optical parameters" can be understood as n sets of X values, Y values, and Z values of n ones of images corresponding to pixel units in the second display panel 20 mentioned above. In particular, with reference to FIGS. 3 to 5, FIG. 5 can be understood as a three-dimensional color parameter chart corresponding to the first display panel 10 or the second display panel 20. "Bonding point colors" can be located on a boundary of the three-dimensional space in FIG. 5 (the three-dimensional space of cuboid is used as an example), for example, they can be located at eight vertices of cuboid (v1 to v8) respectively. Accordingly, "reference bonding point optical parameters" or "bonding point optical parameters" can be three values of vertices of v1 to v8 on three parameter axes.

A step S2 comprises determining non-bonding point optical parameters of the second display panel corresponding to non-bonding point colors between adjacent two of the bonding point colors according to the bonding point colors, the sets of the reference bonding point optical parameters, and the sets of the bonding point optical parameters.

In a first manner, a third interpolation rule can be determined according to a plurality of bonding point colors and a set of bonding point optical parameters corresponding to the second display panel 20 to further determine non-bonding point optical parameters of the second display panel corresponding to the non-bonding point colors, which specifically can comprises the following:

With reference to FIG. 4, based on all points (comprising bonding point colors and non-bonding point colors) of the three-dimensional color parameter chart in the second display panel 20, each point can correspond to a set of the bonding point optical parameters or a set of the non-bonding point optical parameters to indicate a location in a three-dimensional space. In particular, in the step S2, a plurality of brightness or chroma (can be indicated by a pure color image) at the locations respectively can be formed in the three-dimensional space according to "the bonding point colors" and corresponding "sets of the bonding point optical parameters". Furthermore, according to each of the non-bonding point colors and a (brightness or chroma) difference degree between two bonding point colors at two ends, two corresponding bonding point optical parameters (value thereof) are combined to determine the non-bonding point optical parameters corresponding to the non-bonding point colors. Namely, a location in the three-dimensional space in which the non-bonding point colors is located is determined. For example, the non-bonding point color is close to one of the bonding point colors, then a difference degree of the non-bonding point color with other surrounding bonding point colors (for example, obtained by a color analysis instrument) can be further combined to determine at least one direction along which the non-bonding point colors is near the bonding point colors in the three-dimensional space such that non-bonding point optical parameters corresponding to the non-bonding point colors are determined.

Alternatively, in a second manner, the step S2 can comprise: at least according to a first interpolation rule of the bonding point colors and a corresponding set of reference bonding point optical parameters, determining the non-bonding point optical parameters corresponding to the non-bonding point colors of the second display panel. Specifically, it can comprise:

With reference to FIG. 3, based on all points of the three-dimensional color parameter chart in the first display panel 10 (including bonding point colors and non-bonding point colors), three bonding point colors in a shorter distance in the three-dimensional space can be selected, according to a difference degree between a bonding point color at a middle and two other bonding point colors (for example, obtained by a color analysis instrument), and according to a difference between a location determined by the bonding point optical parameter corresponding to the bonding point color at the middle and two locations determined by two corresponding reference bonding point optical parameters of the other two bonding point colors to obtain a sub-interpolation rule of the bonding point optical parameters corresponding to the bonding point color at the middle based on the two bonding point colors at two ends of the middle bonding point color. Similarly, a sub-interpolation rule of the bonding point optical parameters corresponding to each of the bonding point colors based on two bonding point colors at two ends thereof can be determined. A plurality of sub-interpolation rules can form a first interpolation rule.

Furthermore, the first interpolation rule of the first display panel 10 (liquid crystal display panel) determined by the above method is applied to the second display panel 20 (MLED). Similarly, for example, for one of the sub-interpolation rule, any one non-bonding point color located between two corresponding bonding point colors can be found. The sub-interpolation rule is used to determine non-bonding point optical parameters corresponding to the non-bonding point colors. Similarly, non-bonding point optical parameter in the second display panel 20 corresponding to each of the non-bonding point colors can be determined.

Of course, based on the first interpolation rule, sets of reference non-bonding point optical parameters a second interpolation rule can also be determined according to a plurality of non-bonding point colors and the first display panel 10. At least according to the second interpolation rule, the non-bonding point optical parameters corresponding to the non-bonding point colors of the second display panel 20 are determined. The non-bonding point colors are between adjacent two of the bonding point colors. In particular, a first part of the reference non-bonding point optical parameters corresponding to the first part of the non-bonding point colors can be determined according to the first interpolation rule, and a second part of the reference non-bonding point optical parameters corresponding to the second part of the non-bonding point colors can be obtained. According to adjacent two of the non-bonding point colors belonging to the first part of the non-bonding point colors and the second part of the non-bonding point colors, two corresponding reference non-bonding point optical parameters, and with reference to the aforementioned description about "sub-interpolation rule", a second interpolation rule can also be determined. Namely, determination of the second interpolation rule refers to the first interpolation rule and the sets of reference non-bonding point optical parameters and has the higher reliability compared to the first interpolation rule.

Figure 5:
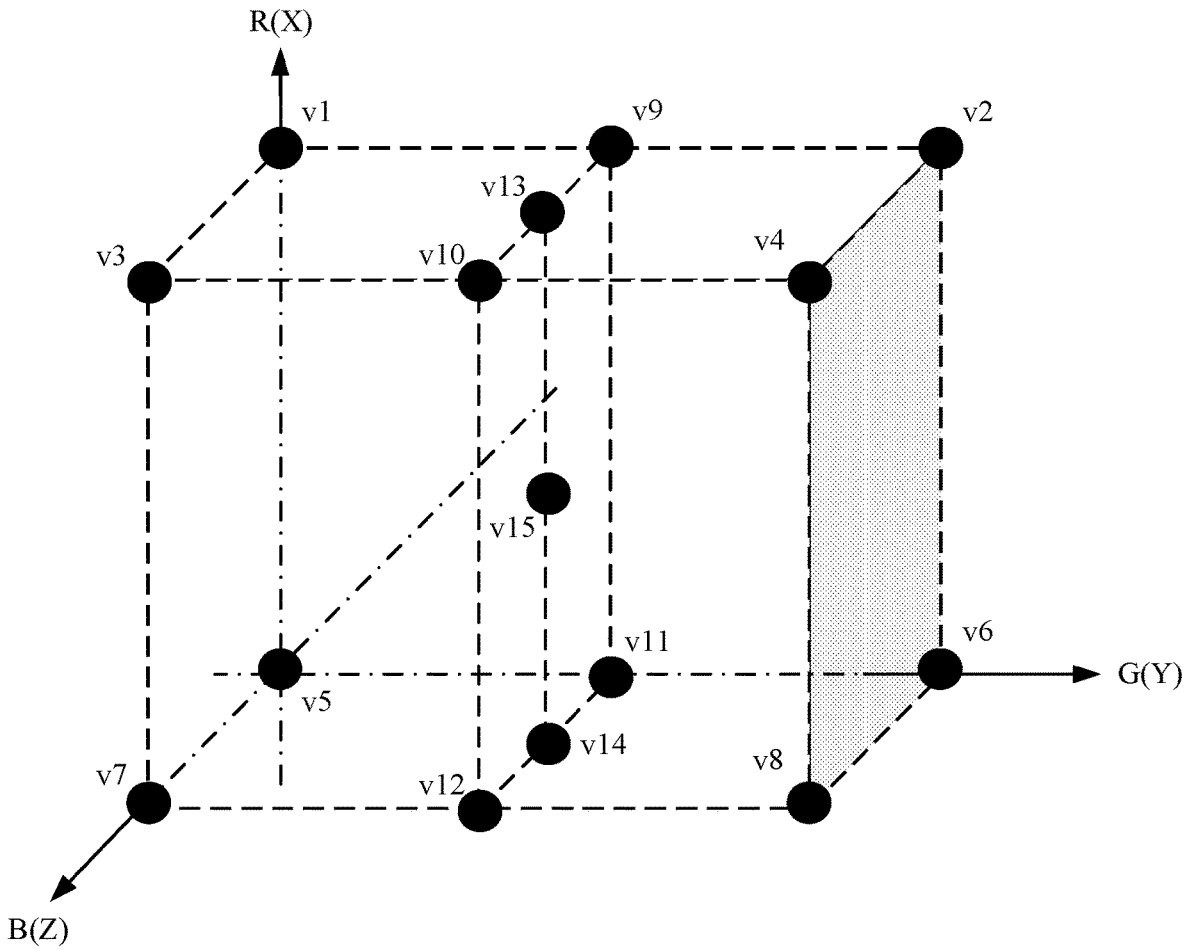
FIG. 5 is a schematic view of a three-dimensional color parameter chart interpolation of the first display panel or the second display panel provided by the embodiment of the present invention.

In particular, with reference to FIG. 5, determining non-bonding point optical parameters corresponding to the non-bonding point colors of the second display panel 20 by either the first interpolation rule or the second interpolation rule can refer to the following method: a non-bonding point optical parameter corresponding to a non-bonding point color v9 between two bonding point colors (for example, v1 and v2) on the same edge can be determined by the first interpolation rule or the second interpolation rule first. Similarly, a non-bonding point optical parameter corresponding to v10 between v3 and v4 can be determined. Similarly, two corresponding non-bonding point optical parameters corresponding to v11 and v12 can be determined to further determine a non-bonding point optical parameter corresponding to v13 between v9 and v10 and a non-bonding point optical parameter corresponding to v14 between v11 and v12, and further, a non-bonding point optical parameter corresponding to v15 between v13 and v14 can be determined.

The first interpolation rule and the second interpolation rule comprise at least one of linear interpolation and non-linear interpolation. In particular, when a number of selected bonding point colors is 2, non-bonding point optical parameters corresponding to the non-bonding point colors between these two bonding point colors can be determined by linear interpolation. When a number of selected bonding point colors is greater than or equal to 3, non-bonding point optical parameters corresponding to non-bonding point colors between these three bonding point colors can be determined by non-linear interpolation. Furthermore, a total number of the bonding point colors in the present embodiment can be larger, and a difference degree between adjacent two of the bonding point colors can be smaller (namely, a distance between two corresponding reference bonding point optical parameters can be smaller) to improve reliability of linear interpolation and non-linear interpolation.

Furthermore, because generally the three-dimensional color parameter chart of the first display panel 10 (liquid crystal display panel) is constant, it can serve as a prerequisite of the present embodiment, "a plurality of non-bonding point optical parameters to be adjusted" corresponding to a plurality of non-bonding point colors can also be determined based on any one of the above methods, then a plurality of non-bonding point colors in the three-dimensional color parameter chart of the first display panel 10 and corresponding sets of reference non-bonding point optical parameters are combined to at least adjust non-bonding point optical parameters to be adjusted such that a pure color image actually displayed by the second display panel 20

(MLED) is subjectively consistent with a pure color image controlled and displayed by reference non-bonding point optical parameters corresponding to the first display panel 10 (for example, by a human factor experiment), which further improve reliability of the non-bonding point optical parameters.

A step S3 comprises determining the optical data according to a correspondence between the bonding point colors and the sets of the bonding point optical parameters and according to a correspondence between the non-bonding point colors and the sets of the non-bonding point optical parameters.

It can be understood in combination with the above description that the first display panel 10 (liquid crystal display panel) and the second display panel 20 (MLED) have a three-dimensional color parameter chart respectively. With reference to FIGS. 3 and 4, the three-dimensional color parameter chart inherently indicates a difference degree among different colors (including the bonding point colors and the non-bonding point colors). Generally the greater of the difference degree between two colors is, an interval between locations of the colors. Also, a color parameter table as shown in Table 1 can also record the correspondence of the set of the reference bonding point optical parameters corresponding to the bonding point colors in FIGS. 3 and 4, and a correspondence between sets of reference non-bonding point optical parameters corresponding to other non-bonding point colors. "Optical data" in the step S3 can be understood as including a plurality of colors (including the bonding point colors and the non-bonding point colors) and corresponding optical parameters (including the bonding point optical parameters and the non-bonding point optical parameters) in the second display panel 20. Namely, at least one of the three-dimensional color parameter chart and the color parameter table of the first display panel 10 can be determined. Furthermore, optical data determined according to the initial splicing display panel 100 can be stored in the initial splicing display panel 100 to form a splicing display panel stored with the optical data.

It can be understood that in combination with the above description, when both the first display panel 10 (liquid crystal display panel) and the second display panel 20 (MLED) in the splicing display panel display images, at least one of the three-dimensional color parameter chart and the color parameter table of the second display panel 20 that the second display panel 20 depends on can relate to sets of reference bonding point optical parameters in the first display panel 10 corresponding to the bonding point colors, and such relationship can be determined by a human factor experiment, which can effectively lower a subjective color difference between display images of the first display panel 10 (liquid crystal display panel) and the second display panel 20 (MLED) and improve quality of display images of the splicing display panel.

Figure 6:
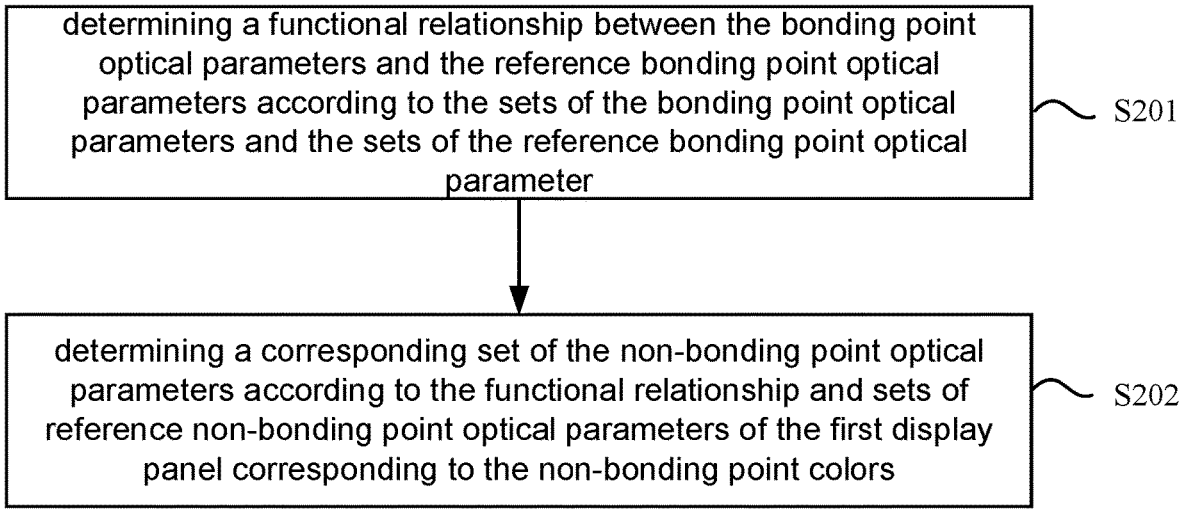
FIG. 6 is another flowchart of a full grayscale subjective consistency optical data obtaining method provided by the embodiment of the present invention.

In an embodiment, with reference to FIG. 6, the step S2 can comprise the following step(s) and a combination thereof.

A step S201 comprises determining a functional relationship between the bonding point optical parameters and the reference bonding point optical parameters according to the sets of the bonding point optical parameters and the sets of the reference bonding point optical parameter.

In combination with the above description, the three-dimensional color parameter chart or color parameter table of the first display panel 10 (liquid crystal display panel) is generally constant, namely, it can be considered that the sets of the reference bonding point optical parameters of the first display panel 10 corresponding to the bonding point colors is predetermined and constant. Furthermore, based on the sets of the reference bonding point optical parameters, and determining the sets of the bonding point optical parameters of the second display panel 20 corresponding to the bonding point colors by a human factor experiment or instrument that is not limitation, can determine a functional relationship therebetween with a fitting method.

A step S202 comprises determining a corresponding set of the non-bonding point optical parameters according to the functional relationship and sets of reference non-bonding point optical parameters of the first display panel corresponding to the non-bonding point colors.

In particular, based on the functional relationship, the reference non-bonding point optical parameter corresponding to the first display panel 10 serves as an independent variable, non-bonding point optical parameter corresponding to the second display panel 20 serves as a dependent variable, then a non-bonding point optical parameter corresponding to each of the reference non-bonding point optical parameters can be determined such that the non-bonding point optical parameters corresponding to the second display panel 20 are determined.

It can be understood that the present embodiment further determines non-bonding point optical parameters corresponding to the reference non-bonding point optical parameters according to a functional relationship between the bonding point optical parameters and the reference bonding point optical parameters. Namely, under each of the non-bonding point colors, corresponding non-bonding point optical parameters is tightly relevant to display characteristics of the first display panel 10. It can be considered that non-bonding point colors presented by each pixel unit in the first display panel 10 (liquid crystal display panel) displaying according to the set of the reference non-bonding point optical parameters is subjectively consistent with non-bonding point colors presented by each pixel unit in the second display panel 20 (MLED) displaying according to the set of the non-bonding point optical parameters, furthermore, they can be identical such that a unified name "non-bonding point colors" can be used.

Figure 7:
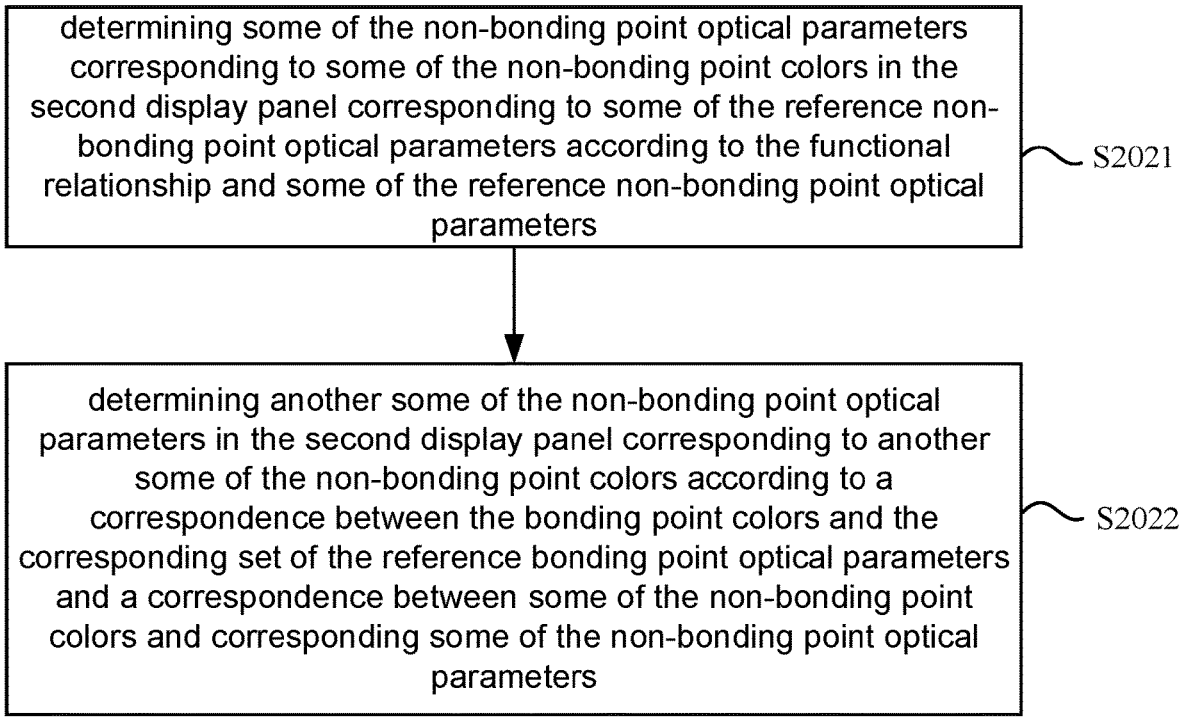
FIG. 7 is another flowchart of the full grayscale subjective consistency optical data obtaining method provided by the embodiment of the present invention.

In an embodiment, with reference to FIG. 7, the step S202 can comprise the following step(s) and a combination thereof.

A step S2021 comprises determining some of the non-bonding point optical parameters corresponding to some of the non-bonding point colors in the second display panel corresponding to some of the reference non-bonding point optical parameters according to the functional relationship and some of the reference non-bonding point optical parameters.

In particular, in combination with the above description, based on the functional relationship, the reference non-bonding point optical parameter serves as an independent variable, and the non-bonding point optical parameter serves as a dependent variable. Furthermore, due to limitation of hardware, some of the reference non-bonding point optical parameters can be selected to calculate corresponding some of the non-bonding point optical parameters in the second display panel 20 by a functional relationship.

A step S2022 comprises determining another some of the non-bonding point optical parameters in the second display panel corresponding to another some of the non-bonding point colors according to a correspondence between the bonding point colors and the corresponding set of the reference bonding point optical parameters and a correspondence between some of the non-bonding point colors and corresponding some of the non-bonding point optical parameters.

In particular, based on a correspondence between the bonding point colors and the corresponding set of the reference bonding point optical parameters, a correspondence between some of the non-bonding point colors and corresponding some of the non-bonding point optical parameters can determine another some of the non-bonding point optical parameters of the second display panel 20 corresponding to another some of the non-bonding point colors according to at least of adjacent two of the bonding point colors and two corresponding reference bonding point optical parameters, adjacent two of the non-bonding point colors and two corresponding non-bonding point optical parameters, adjacent bonding point colors and non-bonding point colors and corresponding bonding point optical parameters and non-bonding point optical parameters by the above "first interpolation rule" without limitation such that non-bonding point optical parameters corresponding to each of the non-bonding point colors can be determined.

In an embodiment, each set of the reference bonding point optical parameters comprises a first sub-reference bonding point optical parameter, a second sub-reference bonding point optical parameter, and a third sub-reference bonding point optical parameter. Each set of the bonding point optical parameters comprises a first sub-bonding point optical parameter, a second sub-bonding point optical parameter, and a third sub-bonding point optical parameter. The step S201 can comprise: determining a first functional relationship between the first sub-bonding point optical parameter and the first sub-reference bonding point optical parameter according to the first sub-bonding point optical parameter and the first sub-reference bonding point optical parameter; and determining a second functional relationship between the second sub-bonding point optical parameter and the second sub-reference bonding point optical parameter according to the second sub-bonding point optical parameter and the second sub-reference bonding point optical parameter; and determining a third functional relationship between the third sub-bonding point optical parameter and the third sub-reference bonding point optical parameter according to the third sub-bonding point optical parameter and the third sub-reference bonding point optical parameter.

In combination with descriptions relating to FIGS. 3 and 5, in a grayscale value viewing angle, the first sub-reference bonding point optical parameter and the first sub-bonding point optical parameter can indicate a value of a first parameter axis (red grayscale value R), the second sub-reference bonding point optical parameter and the second sub-bonding point optical parameter can indicate a value of a second parameter axis (green grayscale value G), and the third sub-reference bonding point optical parameter and the third sub-bonding point optical parameter can indicate a value of a third parameter axis (blue grayscale value B). In combination descriptions relating to FIGS. 4 and 5, in a stimulus value viewing angle, the first sub-reference bonding point optical parameter and the first sub-bonding point optical parameter can indicate the value of the first parameter axis (red stimulus value X), the second sub-reference bonding point optical parameter and the second sub-bonding point optical parameter can indicate the value of the second parameter axis (green stimulus value Y), and the third sub-reference bonding point optical parameter and the third sub-bonding point optical parameter can indicate the value of the third parameter axis (blue stimulus value Z).

Figure 8:
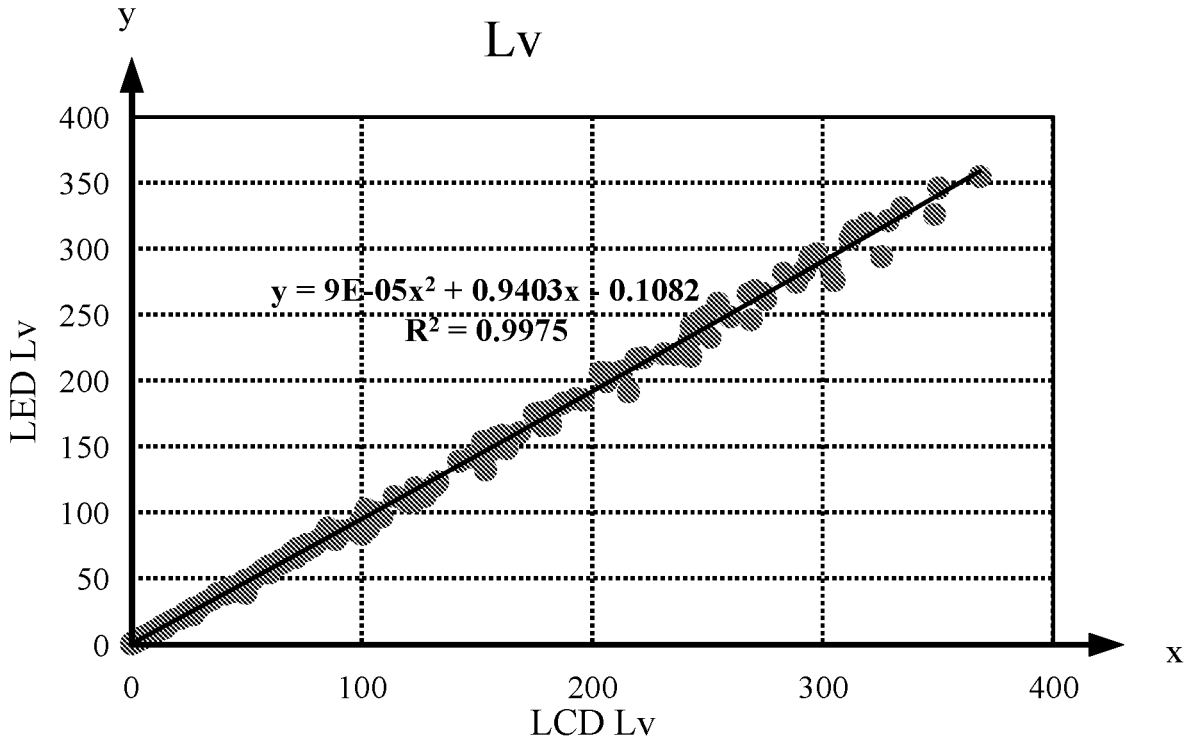
FIG. 8 is a fitting chart of an LED Lv and an LCD Lv provided by the embodiment of the present invention.
Figure 9:
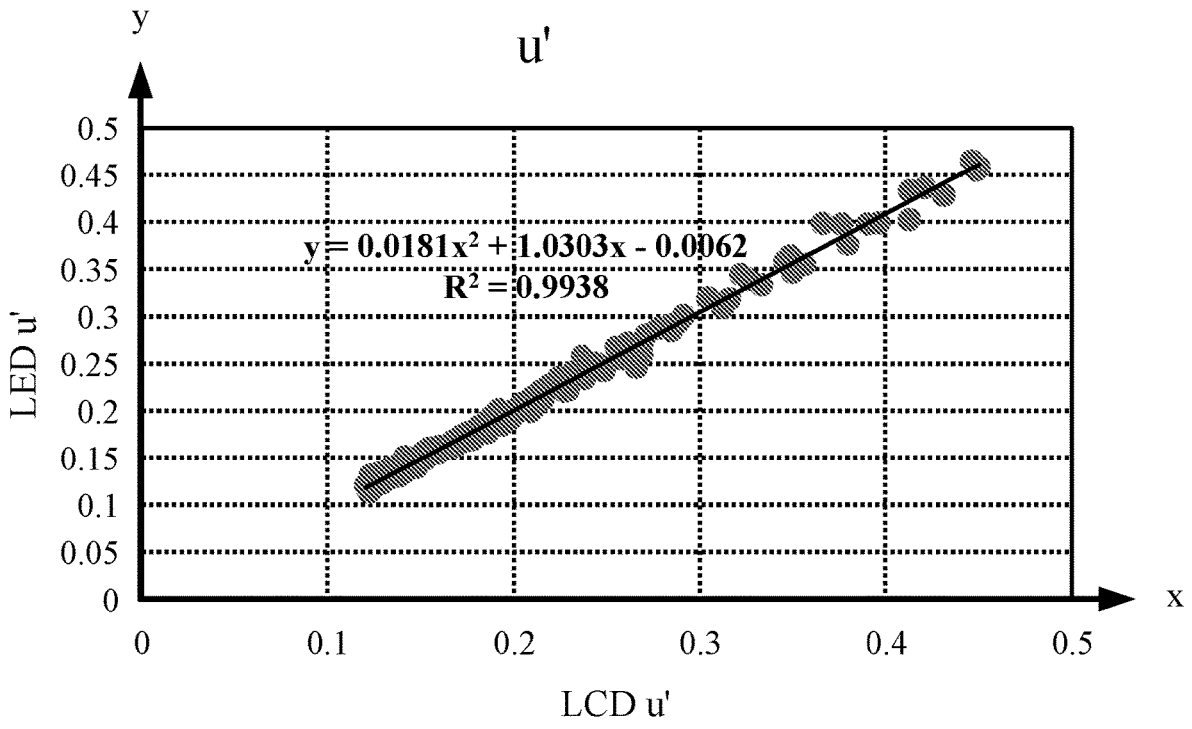
FIG. 9 is a fitting chart of an LED u' and an LCD u' provided by the embodiment of the present invention.

In the present embodiment, both the reference bonding point optical parameters and the reference non-bonding point optical parameters can be LUV-type parameters. In particular, the first sub-reference bonding point optical parameter and the first sub-bonding point optical parameter, the first sub-reference non-bonding point optical parameter and the first sub non-bonding point optical parameter are brightness Lv, the second sub-reference bonding point optical parameter, the second sub-bonding point optical parameter, the second sub-reference non-bonding point optical parameter, and the second sub non-bonding point optical parameter are first chroma u', and the third sub-reference bonding point optical parameter, the third sub-bonding point optical parameter, third sub-reference non-bonding point optical parameter, and the third sub non-bonding point optical parameter are second chroma v', which is taken as an example for explanation:

With reference to FIG. 8, an abscissa x can indicate the first sub-reference bonding point optical parameter (namely, a corresponding brightness Lv (LCD Lv) in the first display panel 10), an ordinate y can indicate first sub-bonding point optical parameter (namely, the corresponding brightness Lv (LED Lv) in the second display panel 20), the first functional relationship refers to $y=9E-05x^2+0.9403x-0.1082$, a corresponding variance $R^2$ is 0.9975;

With reference to FIG. 9, an abscissa x can indicate second sub-reference bonding point optical parameter (namely, a corresponding first chroma u' (LCD u') in the first display panel 10), an ordinate y can indicate second sub-bonding point optical parameter (namely, the corresponding u' (LED u') in the second display panel 20), second functional relationship refers to $y=0.0181x^2+1.0303x-0.0062$, a corresponding variance $R^2$ is 0.9938.

Figure 10:
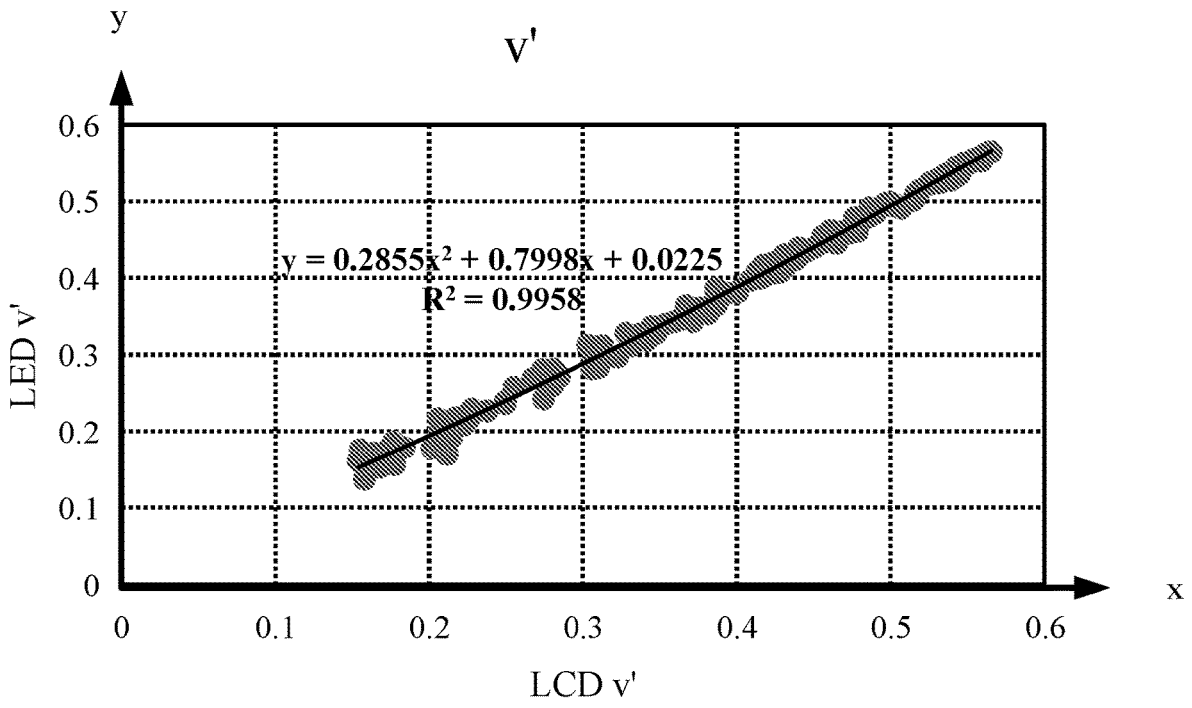
FIG. 10 is a fitting chart of an LED v' and an LCD v' provided by the embodiment of the present invention.

With reference to FIG. 10, an abscissa x can indicate a third sub-reference bonding point optical parameter (namely, a corresponding second chroma v' (LCD v') in the first display panel 10), an ordinate y can indicate a first sub-bonding point optical parameter (namely, the corresponding second chroma v' (LED v') in the second display panel 20), a third functional relationship refers to $y=0.2855x^2+0.7998x+0.0225$, a corresponding variance $R^2$ is 0.9958.

It can be understood that because human's eyes sense differently about a mapping relationship between different sub(reference)-bonding point optical parameters and corresponding bonding point colors presented, namely, therefore it is considered that a functional relationship between sub-reference bonding point optical parameters and corresponding sub-bonding point optical parameters, the present embodiment confirms a functional relationship between different sub-bonding point optical parameters and corresponding sub-reference bonding point optical parameters to determine a first functional relationship that can indicate a correspondence between the first sub-reference bonding point optical parameter and the first sub-bonding point optical parameter, a second functional relationship that can indicate a correspondence between the second sub-reference bonding point optical parameter and the second sub-bonding point optical parameter, and a third functional relationship that can indicate a correspondence between the third sub-reference bonding point optical parameter and the third sub-bonding point optical parameter, which can more clearly fine the functional relationship and improve reliability of confirmation of reliability of the non-bonding point optical parameters.

Figure 11:
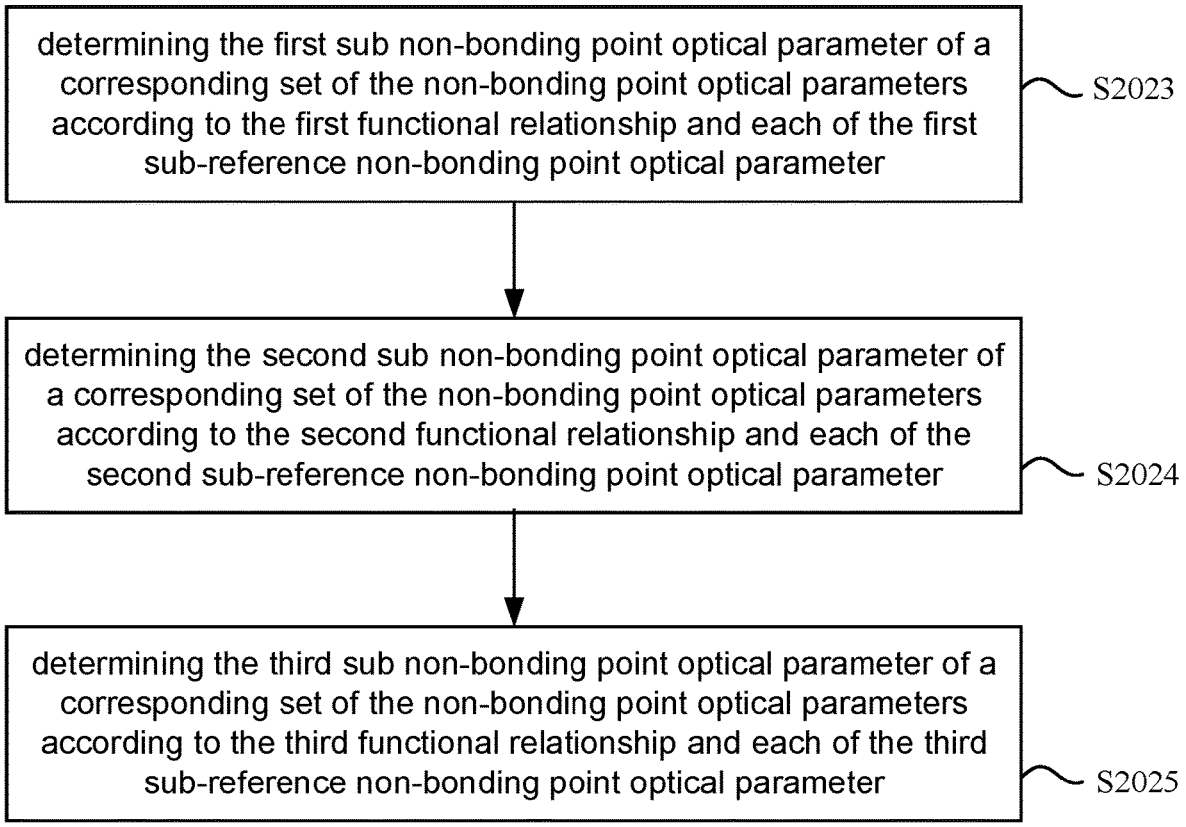
FIG. 11 is another flowchart of the full grayscale subjective consistency optical data obtaining method provided by the embodiment of the present invention.

In an embodiment, each set of the non-bonding point optical parameters comprises a first sub non-bonding point optical parameter, a second sub non-bonding point optical parameter, and a third sub non-bonding point optical parameter. Each set of the reference non-bonding point optical parameters comprises a first sub-reference non-bonding point optical parameter, a second sub-reference non-bonding point optical parameter, and a third sub-reference non-bonding point optical parameter. With reference to FIG. 11, the step S202 can comprise the following step(s) and a combination thereof.

A step S2023 comprises determining the first sub non-bonding point optical parameter of a corresponding set of the non-bonding point optical parameters according to the first functional relationship and each of the first sub-reference non-bonding point optical parameter.

In particular, it can be known in combination with the above description that based on the first functional relationship, the first sub-reference non-bonding point optical parameter serves as an independent variable, and the first sub non-bonding point optical parameter serves as a dependent variable. Furthermore, due to limitation of hardware, first sub-reference non-bonding point optical parameters in some of the reference non-bonding point optical parameters (for example, 17*17* seventeen reference non-bonding point optical parameters) can be selected, first sub non-bonding point optical parameters of some of the non-bonding point optical parameters corresponding to the second display panel 20 are calculated by the first functional relationship.

A step S2024 comprises determining the second sub non-bonding point optical parameter of a corresponding set of the non-bonding point optical parameters according to the second functional relationship and each of the second sub-reference non-bonding point optical parameter.

In particular, it can be known in combination with the above description, based on the second functional relationship, the second sub-reference non-bonding point optical parameter serves as an independent variable, and the second sub non-bonding point optical parameter serves as a dependent variable. Furthermore, due to limitation of hardware, second sub-reference non-bonding point optical parameters of some of the reference non-bonding point optical parameters (for example, 17*17* seventeen reference non-bonding point optical parameters) can be selected, second sub non-bonding point optical parameters of some of the non-bonding point optical parameters in the second display panel 20 are calculated by a second functional relationship.

A step S2025 comprises determining the third sub non-bonding point optical parameter of a corresponding set of the non-bonding point optical parameters according to the third functional relationship and each of the third sub-reference non-bonding point optical parameter.

In particular, it can be known in combination with the above description that based on the third functional relationship, the third sub-reference non-bonding point optical parameter serves as an independent variable, and the third sub non-bonding point optical parameter serves as a dependent variable, Furthermore, due to limitations hardware, third sub-reference non-bonding point optical parameters in some of the reference non-bonding point optical parameters (for example, 17*17*17 sets of the reference non-bonding point optical parameters) can be selected to calculate third sub non-bonding point optical parameters of corresponding some of the non-bonding point optical parameters in the second display panel 20 by the third functional relationship.

It can be understood that similarly, the present embodiment confirms functional relationships (a first functional relationship, a second functional relationship, or a third functional relationship) between different sub-bonding point optical parameters and corresponding sub-reference bonding point optical parameters. Regarding each of the non-bonding point optical parameters, the first sub non-bonding point optical parameter corresponding to the first sub-reference non-bonding point optical parameter, the second sub non-bonding point optical parameter corresponding to the second sub-reference non-bonding point optical parameter, and the third sub non-bonding point optical parameter corresponding to the third sub-reference non-bonding point optical parameter are determined by a respective functional relationship to prevent ambiguously determining sub non-bonding point optical parameters of the sets of the non-bonding point optical parameters according to various functional relationships in the reference bonding point optical parameters and the bonding point optical parameters, which improves reliability of confirmation of the sets of the non-bonding point optical parameters.

In particular, for example, (17*17*17) sets of the reference non-bonding point optical parameters can be selected, namely, it has (17*17*17) ones of the first sub-reference non-bonding point optical parameter, (17*17*17) ones of the second sub-reference non-bonding point optical parameter, and (17*17*17) ones of the third sub-reference non-bonding point optical parameter. All of a value first sub-reference non-bonding point optical parameter, a value of the second sub-reference non-bonding point optical parameter, and a value of the third sub-reference non-bonding point optical parameter comprise seventeen. Based on the first functional relationship, the second functional relationship, and the third functional relationship determined by the sets of the reference bonding point optical parameters and the sets of the bonding point optical parameters, corresponding seventeen first sub non-bonding point optical parameters, corresponding seventeen second sub non-bonding point optical parameters, and corresponding seventeen third sub non-bonding point optical parameters are further determined such that corresponding (17*17*17) sets of non-bonding point optical parameters in the second display panel 20 can be determined. Furthermore, at least one of the aforementioned first interpolation rule and second interpolation rule can be used to determine the three-dimensional color parameter chart or the color parameter table of the second display panel 20.

In an embodiment, before the step S1, the method can comprise but is not limited to the following step(s): converting sets of reference bonding point optical parameters to be converted into the sets of the reference bonding point optical parameters, and converting sets of bonding point optical parameters to be converted into the sets of the bonding point optical parameters according to a first conversion rule. In particular, as described above, the sets of the reference bonding point optical parameters to be converted in the first display panel 10 corresponding to the bonding point colors can be predetermined and constant, sets of bonding point optical parameters to be converted in the second display panel 20 corresponding to bonding point colors are further determined by measurement of a no-limiting human factor experiment or instrument. The reference bonding point optical parameters to be converted and the bonding point optical parameters to be converted can be parameters of the same type or different types different from first type parameter (parameter type of the sets of the reference bonding point optical parameters and the sets of bonding point optical parameters). Furthermore, by the first conversion rule, the reference bonding point optical parameters to be converted and the bonding point optical parameters to be converted are converted into first type parameters, namely, the sets of the reference bonding point optical parameters to be converted are converted into the sets of the reference bonding point optical parameters, and sets of bonding point optical parameters to be converted are converted into sets of bonding point optical parameters.

Both the sets of the reference bonding point optical parameters to be converted and the sets of bonding point optical parameters to be converted can be stimulus value type parameters. With reference to the above descriptions, each of the reference bonding point optical parameters to be converted and each of the bonding point optical parameters to be converted can comprise the three sub-parameters such as a red stimulus value X, a green stimulus value Y, and a blue stimulus value Z (with reference to description about FIG. 4), both the sets of the reference bonding point optical parameters and sets of bonding point optical parameters can be LUV-type parameters (namely, first type parameter). The LUV-type parameters can comprise a brightness Lv, a first chroma u' and a second chroma v', or can comprise a brightness Lv, a third chroma x and a fourth chroma y, or can comprise a normalized brightness L*, a fifth chroma u, and a sixth chroma v, or can comprise a normalized brightness L*, a first chroma u', and a second chroma v', or can comprise normalized brightness L*, a seventh chroma a, and a eighth chroma b. a corresponding first conversion rule is between each of the LUV-type parameters (namely, first type parameter) and stimulus value type parameters as described above.

In an embodiment, the step S2 can comprise but is not limited to the following step(s): the according to the bonding point colors, the sets of the reference bonding point optical parameters and the sets of the bonding point optical parameters, determining non-bonding point optical parameters to be converted in the second display panel corresponding to the non-bonding point colors; and converting the sets of the non-bonding point optical parameters to be converted into the sets of the non-bonding point optical parameters according to a second conversion rule. In particular, similar to the above description, the non-bonding point optical parameters to be converted can be understood as LUV-type parameters (namely, the first type parameter) according to the functional relationship and the reference non-bonding point optical parameters (LUV-type parameters, namely, the first type parameter). Furthermore, by the second conversion rule, non-bonding point optical parameters to be converted (LUV-type parameters, namely, the first type parameter) can be converted into non-bonding point optical parameters having a parameter type being a stimulus value type (namely, including a red stimulus value X, a green stimulus value Y, and a blue stimulus value Z).

Furthermore, sets of grayscale value type (with reference to description about FIG. 3 in the above description) parameter and corresponding sets of stimulus value type parameter one by one in the second display panel 20 can be measured to determine sets of target non-bonding point optical parameters of a grayscale value type corresponding to the sets of the non-bonding point optical parameters to be. By integrating the sets of the target non-bonding point optical parameters of the grayscale value type and corresponding non-bonding point colors, the three-dimensional color parameter chart (grayscale value type) or the color parameter table (grayscale value type) of the second display panel 20 is determined. Sets of grayscale value type parameter in the second display panel 20 measured can comprise or exclude the sets of the non-bonding point optical parameters. Furthermore, by at least one of the aforementioned first interpolation rule and second interpolation rule, (17*17*17) ones of the non-bonding point optical parameters in the second display panel 20 and corresponding (17*17*17) ones of the non-bonding point colors are interpolation-processed by to determine (256*256*256) sets of the bonding point optical parameters, (256*256*256) sets of the non-bonding point optical parameters, (256*256*256) ones of the bonding point colors, and (256*256*256) ones of the non-bonding point colors in the second display panel 20.

The present invention provides a full grayscale subjective consistency optical data obtaining method and a splicing display panel, configured to obtain optical data applied to an initial splicing display panel, wherein the initial splicing display panel comprises a first display panel and a second display panel spliced together, the first display panel comprises a liquid crystal display panel, the second display panel is different from the first display panel in type, and the method comprises: obtaining a plurality of bonding point colors and sets of reference bonding point optical parameters of the first display panel corresponding to the bonding point colors, and determining sets of bonding point optical parameters of the second display panel corresponding to the bonding point colors according to the bonding point colors and the sets of the reference bonding point optical parameters of the first display panel; determining non-bonding point optical parameters of the second display panel corresponding to non-bonding point colors between adjacent two of the bonding point colors according to the bonding point colors, the sets of the reference bonding point optical parameters, and the sets of the bonding point optical parameters; and determining the optical data according to a correspondence between the bonding point colors and the sets of the bonding point optical parameters and according to a correspondence between the non-bonding point colors and the sets of the non-bonding point optical parameters. Because at least one of the three-dimensional color parameter chart and the color parameter table of the second display panel that the second display panel relies on relates to the sets of reference bonding point optical parameters of the first display panel corresponding to the bonding point colors and is obtained by a human factor experiment, a subjective color difference between display images of the first display panel (liquid crystal display panel) and the second display panel (MLED) can be effectively decreased, which improves quality of display images of the splicing display panel.

The full grayscale subjective consistency optical data obtaining method and splicing display panel provided by the embodiment of the present invention are described in detail as above, each functional module thereof can be integrated into a process chip, or either can exist physically individually, or two or more modules can be integrated into one module. The above integrated module can be implemented in form of hardware, and be implemented in form of a software module. In the specification, the specific examples are used to explain the principle and embodiment of the present application. The above description of the embodiments is only used to help understand the method of the present application and its spiritual idea. Meanwhile, for those skilled in the art, according to the present idea of invention, changes will be made in specific embodiment and application. In summary, the contents of this specification should not be construed as limiting the present application.

What is claimed is:

1. A full grayscale subjective consistency optical data obtaining method, configured to obtain optical data applied to an initial splicing display panel, wherein the initial splicing display panel comprises a first display panel and a second display panel spliced together, the first display panel comprises a liquid crystal display panel, the second display panel is different from the first display panel in type, and the method comprises:

obtaining a plurality of bonding point colors, sets of reference bonding point optical parameters of the first display panel corresponding to the bonding point colors and sets of bonding point optical parameters of the second display panel corresponding to the bonding point colors, wherein a display image of the second display panel under effect of each set of the bonding point optical parameters is subjectively consistent with a display image of the first display panel under a corresponding set of the reference bonding point optical parameters;

determining non-bonding point optical parameters of the second display panel corresponding to non-bonding point colors between adjacent two of the bonding point colors according to the bonding point colors, the sets of the reference bonding point optical parameters, and the sets of the bonding point optical parameters; and determining the optical data according to a correspondence between the bonding point colors and the sets of the bonding point optical parameters and according to a correspondence between the non-bonding point colors and the sets of the non-bonding point optical parameters.

2. The full grayscale subjective consistency optical data obtaining method according to claim 1, wherein the step of determining non-bonding point optical parameters of the second display panel corresponding to non-bonding point colors between adjacent two of the bonding point colors according to the bonding point colors, the sets of the reference bonding point optical parameters, and the sets of the bonding point optical parameters, comprises:

determining a functional relationship between the bonding point optical parameters and the reference bonding point optical parameters according to the sets of the bonding point optical parameters and the sets of the reference bonding point optical parameters; and determining a corresponding set of the non-bonding point optical parameters according to the functional relationship and sets of reference non-bonding point optical parameters of the first display panel corresponding to the non-bonding point colors.

3. The full grayscale subjective consistency optical data obtaining method according to claim 2, wherein the step of determining the corresponding set of the non-bonding point optical parameters according to the functional relationship and the sets of the reference non-bonding point optical parameters, comprises:

determining some of the non-bonding point optical parameters corresponding to some of the non-bonding point colors in the second display panel corresponding to some of the reference non-bonding point optical parameters according to the functional relationship and some of the reference non-bonding point optical parameters; and determining another some of the non-bonding point optical parameters in the second display panel corresponding to another some of the non-bonding point colors according to a correspondence between the bonding point colors and the corresponding set of the reference bonding point optical parameters and a correspondence between some of the non-bonding point colors and corresponding some of the non-bonding point optical parameters.

4. The full grayscale subjective consistency optical data obtaining method according to claim 2, wherein each set of the reference bonding point optical parameters comprises a first sub-reference bonding point optical parameter, a second sub-reference bonding point optical parameter, and a third sub-reference bonding point optical parameter, each set of the bonding point optical parameters comprises a first sub-bonding point optical parameter, a second sub-bonding point optical parameter, and a third sub-bonding point optical parameter;

wherein the step of determining a functional relationship between the bonding point optical parameters and the reference bonding point optical parameters according to the sets of the bonding point optical parameters and the sets of the reference bonding point optical parameters, comprises:

determining a first functional relationship between the first sub-bonding point optical parameter and the first sub-reference bonding point optical parameter according to the first sub-bonding point optical parameter and the first sub-reference bonding point optical parameter;

determining a second functional relationship between the second sub-bonding point optical parameter and the second sub-reference bonding point optical parameter according to the second sub-bonding point optical parameter and the second sub-reference bonding point optical parameter; and determining a third functional relationship between the third sub-bonding point optical parameter and the third sub-reference bonding point optical parameter according to the third sub-bonding point optical parameter and the third sub-reference bonding point optical parameter.

5. The full grayscale subjective consistency optical data obtaining method according to claim 4, wherein each set of the non-bonding point optical parameters comprises a first sub non-bonding point optical parameter, a second sub non-bonding point optical parameter, and a third sub non-bonding point optical parameter, each set of the reference non-bonding point optical parameters comprises a first sub-reference non-bonding point optical parameter, a second sub-reference non-bonding point optical parameter, and a third sub-reference non-bonding point optical parameter;

wherein the step of determining the corresponding set of the non-bonding point optical parameters according to the functional relationship and the sets of the reference non-bonding point optical parameters, comprises:

determining the first sub non-bonding point optical parameter of a corresponding set of the non-bonding point optical parameters according to the first functional relationship and each of the first sub-reference non-bonding point optical parameter;

determining the second sub non-bonding point optical parameter of a corresponding set of the non-bonding point optical parameters according to the second functional relationship and each of the second sub-reference non-bonding point optical parameter; and determining the third sub non-bonding point optical parameter of a corresponding set of the non-bonding point optical parameters according to the third functional relationship and each of the third sub-reference non-bonding point optical parameter.

6. The full grayscale subjective consistency optical data obtaining method according to claim 1, wherein before the step of obtaining a plurality of bonding point colors, sets of reference bonding point optical parameters of the first display panel corresponding to the bonding point colors and sets of bonding point optical parameters of the second display panel corresponding to the bonding point colors, the method comprises:

converting sets of reference bonding point optical parameters to be converted into the sets of the reference bonding point optical parameters, and converting sets of bonding point optical parameters to be converted into the sets of the bonding point optical parameters according to a first conversion rule.

7. The full grayscale subjective consistency optical data obtaining method according to claim 1, wherein the step of determining non-bonding point optical parameters of the second display panel corresponding to non-bonding point colors between adjacent two of the bonding point colors according to the bonding point colors, the sets of the reference bonding point optical parameters, and the sets of the bonding point optical parameters, comprises:

the according to the bonding point colors, the sets of the reference bonding point optical parameters and the sets of the bonding point optical parameters, determining non-bonding point optical parameters to be converted in the second display panel corresponding to the non-bonding point colors; and converting the sets of the non-bonding point optical parameters to be converted into the sets of the non-bonding point optical parameters according to a second conversion rule.

8. The full grayscale subjective consistency optical data obtaining method according to claim 1, wherein the step of determining non-bonding point optical parameters of the second display panel corresponding to non-bonding point colors between adjacent two of the bonding point colors according to the bonding point colors, the sets of the reference bonding point optical parameters, and the sets of the bonding point optical parameters, comprises:

determining the non-bonding point optical parameters of the second display panel corresponding to the non-bonding point colors at least according to a first interpolation rule determined by the bonding point colors and the sets of the reference bonding point optical parameters.

9. The full grayscale subjective consistency optical data obtaining method according to claim 8, wherein the step of determining the non-bonding point optical parameters of the second display panel corresponding to the non-bonding point colors at least according to a first interpolation rule determined by the bonding point colors and the sets of the reference bonding point optical parameters, comprises:

obtaining sets of reference non-bonding point optical parameters of the first display panel corresponding to the non-bonding point colors, and determining a second interpolation rule according to the first interpolation rule, the non-bonding point colors and the sets of the reference non-bonding point optical parameters; and at least according to the second interpolation rule, determining the non-bonding point optical parameters of the second display panel corresponding to the non-bonding point colors.

10. A splicing display panel, comprising:

the initial splicing display panel according to claim 1;

a signal transmitting card electrically connected to the first display panel and the second display panel in the initial splicing display panel;

wherein the optical data is stored in the signal transmitting card, and the optical data is at least configured to control the second display panel to display images.

* * * * *